United States Patent [19]

Libertini et al.

[11] Patent Number: 4,643,636

[45] Date of Patent: Feb. 17, 1987

[54] CERAMIC NOZZLE ASSEMBLY FOR GAS TURBINE ENGINE

[75] Inventors: Zoltan Libertini, Stamford; Hsianmin Jen, Milford; James Martinelli, Fairview, all of Conn.

[73] Assignee: Avco Corporation, Stratford, Conn.

[21] Appl. No.: 757,256

[22] Filed: Jul. 22, 1985

[51] Int. Cl.[4] ..... F01D 9/04

[52] U.S. Cl. ..... 415/138; 415/190; 415/217; 415/214

[58] Field of Search ..... 415/134, 137, 138, 139, 415/189, 190, 191, 200, 214, 217, 218

[56] References Cited

U.S. PATENT DOCUMENTS

| | | | |
|---|---|---|---|
| 1,362,437 | 12/1920 | Robb | 415/217 X |
| 2,264,877 | 12/1941 | Haigh | 415/217 X |
| 2,766,963 | 10/1956 | Zimmerman | 415/218 |
| 3,824,034 | 7/1974 | Leicht | 415/217 |
| 3,867,063 | 2/1975 | Bulavin et al. | 415/138 X |
| 3,867,065 | 2/1975 | Schaller et al. | 415/217 X |
| 3,901,622 | 8/1975 | Ricketts | 415/134 |
| 3,910,716 | 10/1975 | Roughgarden et al. | 415/214 X |
| 4,008,978 | 2/1977 | Smale | 415/134 |

FOREIGN PATENT DOCUMENTS

| | | | |
|---|---|---|---|
| 395142 | 12/1965 | Switzerland | 415/217 |
| 1020900 | 2/1966 | United Kingdom | 415/136 |

*Primary Examiner*—Robert E. Garrett
*Assistant Examiner*—Joseph M. Pitko
*Attorney, Agent, or Firm*—Ralph D. Gelling

[57] ABSTRACT

A ceramic nozzle assembly for a gas turbine engine is provided. The assembly includes ceramic inner and outer shroud rings dimensioned to be concentrically disposed relative to one another. Recesses are provided in the outer circumferential surface of the inner shroud ring and apertures extend through the outer shroud ring in register with the recesses. Vanes extend through the apertures in the outer shroud ring and are engaged by the recesses in the inner shroud ring. A ceramic outer support ring slides over the outer shroud ring to securely retain the vanes. Slots or recesses are provided in both the inner and outer shroud ring to prevent rotation of the nozzle in the engine.

16 Claims, 3 Drawing Figures

CERAMIC NOZZLE ASSEMBLY FOR GAS TURBINE ENGINE

BACKGROUND OF THE INVENTION

Gas turbine engines include a compressor for compressing air, a combustor for burning fuel in the pressure of the compressed air and a turbine for providing power. The turbine of the engine comprises at least one rotor which is a rotatable array of radially aligned blades. Rotors are adapted to rotate when impinged upon by gases produced in the combustor of the engine. This rotation of the turbine rotors produces the thrust of the engine and the power to operate the compressor for directing compressed air into the combustor.

The efficiency of the turbine engine depends partly upon the angle at which the combustion gases approach the rotor. Thus, a nozzle, or an array of nonrotatable blades, is positioned in advance of each rotatable array of turbine blades. The nozzle changes the direction of the combustion gases to insure that these gases approach the turbine rotor blades at an angle that will insure most efficient operation of the engine.

Efficiency of the turbine engine also is directly proportional to the temperature of the combustion gases approaching the rotating arrays of turbine blades. Thus, greater engine efficiency is possible when higher temperatures can be employed. In most prior art gas turbine engines, the metallurgical characteristics of the engine components impose limits upon the engine operating temperatures. As a result, most prior art gas turbine engines have utilized a portion of the air compressed by the engine to cool portions of the engine that otherwise might be damaged by the high temperature combustion gases. This compressed air required for cooling otherwise would have been directed to the combustor to contribute to even higher temperature combustion gases, and hence even greater efficiency.

Several gas turbine engines have been manufactured in recent years which utilize ceramic components at locations subjected to particularly high temperatures. The ceramic components can withstand much higher temperatures than most metals. Consequently it is unnecessary to cool the ceramic components and it is possible to utilize combustion gases at higher temperatures. This reduction of cooling and the related increase in combustion gas temperature can result in improved engine efficiency.

One gas turbine engine which employs ceramic components is shown in U.S. Pat. No. 4,398,866 which issued to Hartel et al on Aug. 16, 1983 and is assigned to the assignee of the subject invention. U.S. Pat. No. 4,398,866 is directed to a gas turbine engine wherein a radially inner ceramic ring is disposed in juxtaposed relationship to the tips of a turbine rotor. An arrangement of two annular ceramic rings each of which is substantially L-shaped in cross-section is disposed adjacent to the inner ceramic ring and radially outwardly therefrom. The two L-shaped cross-section rings effectively entrap the inner ceramic ring. An outer metallic support holds the two L-shaped cross-section rings in proper relationship to the inner ceramic ring and the rotor during various conditions of operation. The entrapment of the inner ceramic ring is achieved through inclined adjacent surfaces which substantially insure the structural integrity of the ceramic members in the event of a crack therein. The metal members also can be provided with a preload biasing force to insure the proper relationship of the components during conditions when the combustion gases are not imposing forces upon the engine components.

Another engine employing ceramic components is shown in U.S. Pat. No. 4,008,978 which issued to Smale on Feb. 22, 1977. U.S. Pat. No. 4,008,978 includes an inlet turbine nozzle of cast ceramic construction. The nozzle includes a plurality of ceramic vanes extending generally radially between an annular ceramic base and an annular outer ring portion. The engine of U.S. Pat. No. 4,008,978 further includes ceramic rotors and stators disposed axially along the engine as well as ceramic shroud rings and tip shrouds. The various annular members all are circumferentially segmented to enable easy manufacture.

Other gas turbine engines employing ceramic components are shown in: U.S. Pat. No. 4,260,327 which issued to Armor et al on April 7, 1981; U.S. Pat. No. 4,365,933 which issued to Langer et al on Dec. 28, 1983; U.S. Pat. No. 4,273,824 which issued to McComas et al on June 16, 1981; U.S. Pat. No. 3,901,622 which issued to Ricketts on Aug. 26, 1975; U.S. Pat. No. 3,867,065 which issued Schaller et al on Feb. 18, 1975; U.S. Pat. No. 3,635,577 which issued to Dee on Jan. 18, 1972; U.S. Pat. No. 2,668,413 which issued to Giliberty on Feb. 9, 1954 and German Offenlegungschrift No. 28 31 547 which issued to Norton Company on Feb. 1, 1979.

Although most of the above identified references have the advantage of enabling higher engine temperatures and hence higher efficiency, it has been recognized that room for significant improvements still remain. For example, the turbine nozzle is subjected to higher temperatures than any of the downstream rotors or stators of the turbine assembly. Consequently it would be desirable to provide a nozzle formed entirely of ceramic material. Additionally, many of the known gas turbine engines with ceramic components utilize small, complex interlocking are sections to form the various annular members of the gas turbine engine. This use of short arc sections purportedly facilitates manufacturing. However, while these large number of sections may have overcome certain heretofore difficult manufacturing problems, they have created greater problems associated with the manufacture and assembly of a great number of parts. Most engines employing a large number of circumferential sections generally have not addressed the problem of certain portions of these segments cracking, breaking off and causing extensive damage to turbine sections downstream. Additionally, many of the prior art engines have not adequately addressed the problems associated with affixing ceramic components to adjacent metal components. The structures to accomplish these ceramic to metal connections have generally been very complex.

Accordingly, it is an object of the subject invention to provide a gas turbine engine having an improved ceramic nozzle assembly.

It is another object of the subject invention to provide a gas turbine engine having a nozzle formed from a relatively small number of parts.

It is an additional object of the subject invention to provide a gas turbine engine having a nozzle that can be easily assembly.

It is a further object of the subject invention to provide a gas turbine engine having a nozzle that can be securely and easily mounted relative to the metal engine components adjacent thereto.

It is still another object of the subject invention to provide a gas turbine engine having a ceramic nozzle assembly that is securely and nonrotationally mounted in the engine.

Another object of the subject invention is to provide a gas turbine nozzle that substantially prevents parts thereof from falling inwardly and into contact with other components of the engine.

SUMMARY OF THE INVENTION

The subject invention is directed to a gas turbine nozzle formed entirely from ceramic materials. The nozzle is intended for placement in the engine intermediate the combustor and the first stage turbine rotor. The nozzle may be formed from one of the many available ceramic materials. Preferably, however, the nozzle is formed from either silicon nitride or silicon carbide.

The nozzle assembly of the subject invention preferably includes an annular inner shroud ring which is formed entirely from a ceramic material and defines the radially innermost portion of the ceramic nozzle assembly. The outer circumferential surface of the inner shroud ring is defined by a plurality of vane retaining means for securely retaining the radially aligned vanes as explained further below.

The ceramic nozzle assembly further includes an annular outer shroud ring, which also is formed from a ceramic material. The outer shroud ring is dimensioned to be mounted circumferentially around the inner shroud ring with an annular gas therebetween. The annular gap, as explained in detail below, will accomodate the vanes of the nozzle. The outer shroud ring further is provided with a plurality of vane retaining means which are radially in register with the vane retaining means in the inner shroud ring. The vane retaining means may be apertures extending generally radially through the outer shroud ring.

The ceramic nozzle assembly further includes a plurality of radially aligned vanes extending between the inner and outer shroud rings. More particularly, the vanes are mounted in and extend radially between the respective retaining means of the inner and outer shroud rings. Each vanes may include inner and outer mounting bases which are dimensioned and configured to be securely engaged by the retaining means in the inner and outer shroud rings. In a preferred embodiment, explained in greater detail below, the vanes extend radially through apertures in the outer shroud ring and are engaged by the recesses in the outer circumferential surface of the inner shroud ring.

The ceramic nozzle assembly of the subject invention may also include a ceramic outer support ring that is generally annular in configuration and is dimensioned to slide over at least a portion of the outer circumferential surface of the outer support ring. More particularly, the outer support ring is dimensioned and configured to securely retain the vanes in their respective positions between the inner and outer shroud rings.

The prior art metallic nozzles were securely affixed in the engine by brazing, welding or the like. This secure mounting of metal-to-metal prevented the nozzle from moving in an axial direction and from rotating. The temperature and pressure related expansion and contraction that occurred in the engine generally could be easily accomodated by the dimensional changes of the various metallic members. Ceramic materials, on the other hand, do not undergo significant temperature and pressure related dimensional changes. Consequently there is a potential problem caused by differential expansion and contraction of the metallic and ceramic components respectively. Additionally, ceramic components can not be fastened securely to metallic components by standard techniques such as wellding, brazing and the like.

The ceramic nozzle assembly of the subject invention, as described briefly above, overcomes these problems of secure mounting in the engine and accommodation of differential expansion. More particularly, the ceramic nozzle assembly of the subject invention includes anti-rotation means which mounts to anti-rotation supports on the engine. For example, the anti-rotation means may be disposed on the inner shroud ring and/or the outer shroud ring. The anti-rotation means may be recesses, protrusions or the like that mate with corresponding supports on the engine to prevent rotation of the nozzle in response to the forces exerted by combustion gases.

To facilitate temperature and pressure related differential expansion and contraction within the engine and to facilitate sudden changes in pressure, it is preferred that the ceramic nozzle assembly be loosely fit into the engine. Thus, a controlled amount of resiliency or floating is possible within the confines of the nozzle mounting space. This loose fit, floating or resilient mounting of the ceramic nozzle assembly enables the assembly to accomodate sudden changes in force exerted thereon and differential expansion and contraction. For example, the nozzle assembly may be biased into its mounting space in the engine by spring means. Forces exerted on the nozzle assembly during operation of the engine can result in movements that are accomodated by the spring means.

Preferably the ceramic nozzle assembly described above is axially retained in the engine by at least one spring member which is operative to bias the ceramic nozzle assembly against appropriate supports in the engine. For example, the ceramic nozzle assembly may be adapted to be loaded into the engine in an aft direction and to be positioned adjacent metallic supports therein. At least one spring member can be provided to urge the ceramic nozzle assembly against the metallic supports. For example, an annular spring seal plate can be mounted adjacent the combustor and adapted to urge the outer shroud ring in an aft direction such that the entire radially outward portion of the ceramic nozzle assembly is urged into an appropriate outer metal support. Similarly, a thrust plate and appropriate spring means can be disposed intermediate the inner shroud ring and an adjacent structural support of the engine to urge the inner shroud ring in an aft direction such that the entire radially innermost portion of the ceramic nozzle assembly is biased into contact with an inner metal support.

To insure that any damaged or broken components of the subject ceramic nozzle assembly can not fall inwardly to damage other parts of the engine the various supporting surfaces of the ceramic nozzle assembly may be tapered to prevent the radially inward movement of any broken parts. For example, the leading and trailing edges of both the inner and outer shroud rings may be tapered at the locations thereon that will be supported or engaged by adjacent components of the engine. Similarly, the mating surfaces between the individual vanes and the inner and outer shroud ring and between the outer shroud ring and the outer support ring may also be tapered to prevent an inward separation of any portion of the ceramic nozzle assembly that might become broken after installation.

DETAILED DESCRIPTION OF THE PREFERRED EMBODIMENT

Figure 1:
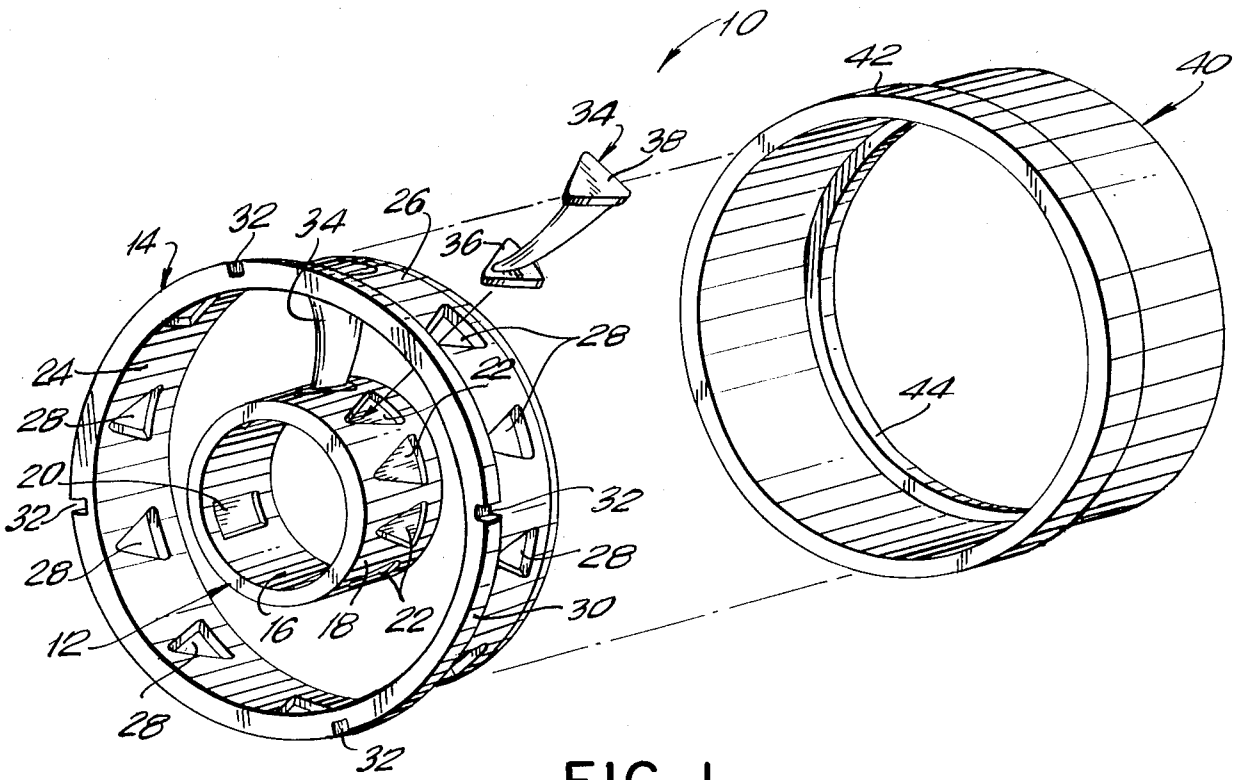
FIG. 1 is a schematic exploded perspective view of the ceramic nozzle assembly of the subject invention.

The ceramic nozzle assembly of the subject invention is indicated generally by the numeral 10 in FIG. 1. The nozzle assembly 10 includes a generally annular inner shroud ring 12 and a generally annular outer shroud ring 14 concentrically surrounding the inner shroud ring 12. The inner and outer shroud rings 12 and 14 are preferably cast entirely from ceramics, and thus are able to withstand high temperatures as explained in detail herein.

The inner shroud ring 12 includes opposed inner and outer circumferential surfaces 16 and 18, respectively. The inner circumferential surface 16 of the inner shroud ring 12 is provided with a plurality of anti-rotation pockets 20 extending in a generally radially outward direction into the inner shroud ring 12. As explained herein below, the anti-rotation pockets 20 cooperate with an anti-rotation support on the engine to prevent the ceramic nozzle assembly 10 from rotating in response to the forces of the combustion gases.

The outer circumferential surface 18 of the inner shroud ring 12 is provided with a plurality of vane retaining recesses 22 extending in a generally radially inward direction into the inner shroud ring 12. The recesses 22 in the inner shroud ring are configured to accept the vanes of the ceramic nozzle assembly 10 as explained herein.

The outer shroud ring 14 also is provided with opposed inner and outer circumferential surfaces 24 and 26 respectively. The outer shroud ring 14 includes a plurality of generally radially aligned vane retaining through apertures 28 which extend between the opposed inner and outer surfaces 24 and 26 thereof. The number of vane retaining through apertures 28 in the outer shroud ring 14 equals the number of vane retaining recesses 22 in the inner shroud ring 12. More particularly, the through apertures 28 in the outer shroud ring 14 are radially in register with the respective recesses 22 in the inner shroud ring 12. Both the apertures 28 and the recesses 22 are adapted to receive the vanes of the ceramic nozzle assembly 10.

The outer shroud ring 14 further includes an enlarged diameter, outwardly extending flange 30 disposed at one axial end thereof. The enlarged flange 30 provides a surface at the associated axial end of the outer shroud ring 14 against which an adjacent metallic component of the engine can bear for retaining the ceramic nozzle assembly 10 in the engine. The enlarged diameter flange 30 is characterized by a plurality of generally axially aligned antirotation slots 32 extending substantially entirely therethrough. The slots 32 are adapted to receive anti-rotation supports affixed to the engine for preventing rotation of the ceramic nozzle assembly 10 in response to forces exerted thereon by the combustion gases.

The ceramic nozzle assembly 10 further includes a plurality of vanes 34 which respectively extend in radial directions between the inner and outer shroud rings 12 and 14. Each vane 34 includes a radially inner base 36 at one end thereof and a radially outer base 38 at the opposed end thereof. The inner base 36 of each vane 34 is dimensioned to pass through an aperture 28 in the outer shroud ring 14 and to be securely seated in one of the recesses 22 in the inner shroud ring 12. Similarly, the outer base 38 is dimensioned to be securely received in the apertures 28 of the outer shroud ring 14. The respective radial lengths of the vanes 34 are selected to insure that the outer base 38 is substantially in line with the outer circumferential surface 26 of the outer shroud ring 14 when the vanes 34 are fully seated in the recesses 22 of the inner shroud ring 12. It also is preferred that the respective mating surfaces adjacent apertures 28 and the outer bases 38 be tapered. More particularly, the area defined by the apertures 28 adjacent the inner circumferential surface 24 should be smaller than the area defined by apertures 28 adjacent the outer circumferential surface 26. The outer base 38 of each vane 34 should be similarly tapered. This configuration facilitates the assembly of the ceramic nozzle assembly 10 and further prevents the vane 34 from falling inwardly should a portion of the vane 34 become broken during use. The bases 36 and 38 prevent twisting of vanes 34.

The ceramic nozzle assembly 10 further includes an annular outer support ring 40 which is dimensioned to slide over the end of the outer shroud ring 14 opposite the enlarged flange 30 thereof. Most particularly, the outer support ring 40 is dimensioned to slidably engage substantially the entire portion of the outer shroud ring 14 through which the apertures 28 extend. Thus, the outer support ring 40 will also engage the outer bases 38 of the vanes 34 to securely retain the vanes 34 in position between the inner and outer shroud rings 12 and 14 respectively. As a result, each vane 34 will be prevented from moving in an axial or circumferential direction by the respective recesses and apertures in the inner and outer shroud rings 12 and 14 respectively. Similarly, each vane 34 will be prevented from moving either inwardly or outwardly in a radial direction by both the inner shroud ring 12 and the outer support ring 40.

The outer support ring 40 preferably includes an outwardly extending flange 42 adjacent one axial end thereof and an inwardly extending flange 44 adjacent the opposed axial end thereof. The outwardly extending flange 42 preferably has an outer diameter approximately equal to the outer diameter of the flange 30 on the outer shroud ring 14. The outwardly extending flange 42 thus defines a bearing surface for supporting the entire ceramic nozzle assembly 10 in the engine as explained below. The inwardly directed flange 44 defines a circular opening the diameter of which is substantially equal to the diameter defined by the inner circumferential surface 24 of the outer shroud ring 14. The inwardly extending flange 44 abuts against the end of the outer shroud ring 14 opposite the flange 30 thereof when the outer support ring is in its fully seated position.

The various components of the ceramic nozzle assembly 10 can be assembly as illustrated in FIG. 1. Specifically, the inner and outer shroud rings 12 and 14 are positioned concentrically with respect to one another. The vanes 34 then are advanced radially inwardly such that the inner base 36 of each vane 34 passes through an aperture 28 in the outer shroud ring 14 and becomes securely seated in a corresponding recess 22 in the inner shroud ring 12. In this fully seated position, the outer base 38 of each vane 34 will be substantially in line with the circumferential outer surface 26 of the outer shroud ring 14. After the various vanes 34 have been completely seated in the respective recesses 22 and apertures 28 of the inner and outer shroud rings 12 and 14, the outer support ring 40 is slid into engagement with the outer shroud ring 14 and with the respective outer bases 38 of vanes 34. Thus, the outer support ring 40 prevents the vanes 34 from moving radially outwardly, and also cooperates with the vanes 34 to prevent relative movement between the inner and outer shroud rings 12 and 14.

Figure 2:
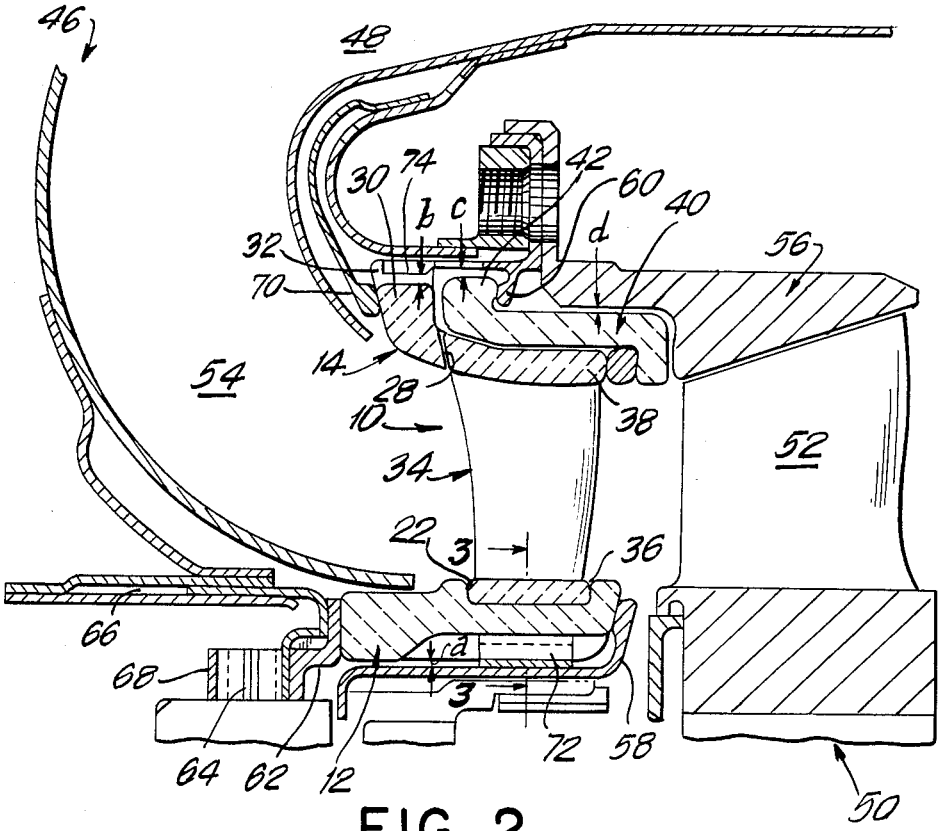
FIG. 2 is a cross-sectional view of the ceramic nozzle assembly of the subject invention mounted in a gas turbine engine.
Figure 3:
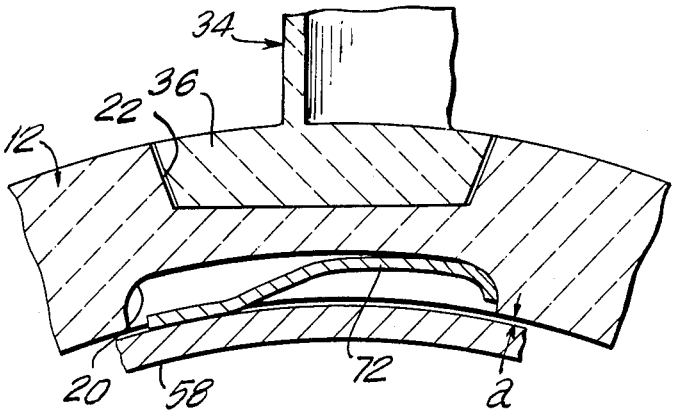
FIG. 3 is a cross-sectional view taken along line 3—3 in FIG. 2.

Turning to FIGS. 2 and 3, the assembled ceramic nozzle assembly 10 is shown mounted in an engine indicated generally by the numeral 46 in FIG. 2. The engine 46 further includes a combustor 48 and a turbine 50 the first stage rotor 52 of which is illustrated in FIG. 2. A generally annular passageway 54 extends between the combustor 48 and the nozzle 10. Combustion gases produced by the combustion of fuel in the presence of compressed air in the combustor 48 travel through the passageway 54 and impinge upon the nozzle 10. The function of the nozzle 10 is to change the direction of the compressed air approximately 70° so that it impinges upon the first stage turbine rotor 52 at an angle which achieves the most efficient utilization of forces for turning the turbine rotor 52. The typical gas turbine engine will include additional stages of stators and rotors for further production of power. To insure that substantially all of the gas directed through the nozzle 10 impinges upon and drives the rotor 52, a nonrotating turbine shroud 56 is mounted in close proximity to the extreme radial tips of the turbine rotor 52.

The ceramic nozzle assembly 10 of the subject invention is biasingly retained in the engine such that the axis of the ceramic nozzle assembly 10 is substantially coincident with the rotation axis of the turbine 50. More particularly, the ceramic nozzle assembly 10 is loaded aft into the engine such that one axial end of the inner shroud ring 12 abuts against an inner metal support 58, and such that the outwardly extending flange 42 of the outer support ring 40 abuts against an outer metal support 60. The inner and outer metal supports are securely mounted to nonrotatable parts of the engine 46. Thus, for example, the outer metal support 60 is securely mounted to the shroud 56. The inner and outer metal supports 58 and 60 can be either annular support members disposed in contact with the inner shroud ring 12 and the outer support ring 40 completely around the respective circumferences thereof. Alternatively, the inner and outer metal supports 50 and 60 can be disposed at selected intervals around the circumference of the ceramic nozzle assembly 10 to provide the necessary support.

It should be noted that the respective points of contact of the inner shroud ring 12 and the inner metal support 58 and between the outer support ring 40 and the outer metal support 60 are angled relative to a radius extending through the rotational axis of the engine. More particularly, the angles are such that at any radial distance from the axis of the ceramic nozzle assembly 10, the inner and outer metal support 58 and 60 are disposed radially inwardly relative to the portion of the ceramic nozzle assembly 10 to which it is adjacent. As a result of this structure, the inner and outer metal supports 58 and 60 contribute to a radially outward support of the ceramic nozzle assembly. Consequently any stress fractures or such that may occur in the ceramic nozzle assembly 10 will not cause a portion of the ceramic nozzle assembly 10 to fall inwardly into positions where it can flow downstream to damage other parts of the engine 46.

The inner shroud ring 12 is biased against the inner metal support 58 by an axially movable thrust plate 62 which is biased in an aft direction by spring means 64. More particularly, the thrust plate 62 includes an axial guide 66 which insures that only an axial movement of thrust plate 62 is possible. The spring member 64 is disposed intermediate stationary support 68 and the thrust plate 62. The thrust plate 62, the spring 64 and the support 68 preferably are annular in configuration. However, a plurality of spaced apart thrust plates, springs and supports disposed in annular array may be acceptable in certain situations.

The radially outermost portion of the ceramic nozzle assembly 10 is biased against the outer metal support 60 by the spring seal plate 70. More particularly, the spring seal plate 70 is nonrotatably mounted to the engine 46 and exerts an aft biasing force against the flange 30. This biasing force by the spring seal plate 70 urges the outer shroud ring 14 into the inwardly directed flange 44 of the outer support ring 40. Thus, the aft force on the outer shroud ring 14 urges the outer support ring 40 in an aft direction such that the outwardly extending flange 42 thereof is biased into contact with the outer metal support 60. In this manner, the spring seal plate 70 helps hold the components of the ceramic nozzle assembly 10 together while holding the entire assembly 10 in the proper position in engine 46.

As explained previously, the inner shroud ring 14 includes a plurality of outwardly extending recesses 20 formed in the inner circumferential surface 16 thereof. As shown in both FIGS. 2 and 3, the recesses 20 mate with anti-rotation springs which are securely mounted to a non-rotating member of the engine 46. The anti-rotation springs 72 thus engage the walls of the recesses 20 in the inner shroud ring to prevent rotational movement of both the inner shroud ring 12 and the entire ceramic nozzle assembly 10. Thus, the forces exerted by the combustion gases flowing through passageway 54 and into contact with the vanes 34 of the ceramic nozzle assembly 10 will not cause a rotational movement of the ceramic nozzle assembly 10. Rather, the anti-rotation springs 72 will be urged into contact with the walls of recesses 20 thereby preventing rotation of the inner shroud ring 12.

Rotation of the ceramic nozzle assembly 10 also is prevented by anti-rotation supports 74 which engage the axially aligned slots 32 in the enlarged flange 30 of the outer shroud ring 14. the anti-rotation supports 74 are securely mounted to a nonrotating part of the engine 46, such as the shroud 56 as shown in FIG. 2. Thus the anti-rotation supports 74 engage the outer shroud ring 14 at the slots 32 to prevent rotation of the ceramic nozzle assembly 10 in response to forces exerted on vanes 34 by the combustion gases.

It should be noted in this respect that the anti-rotation springs 72 and the anti-rotation supports 74 cooperate with one another in preventing rotation of the ceramic nozzle assembly 10. On the prior art metallic nozzles this rotation was prevented by secure metal-to-metal attachments such as brazing or welding, as explained above The mounting of the vanes 34 to the ceramic nozzle assembly 10 is illustrated clearly in FIGS. 2 and 3. More particularly, each recess 22 in the inner shroud ring is dimensioned to securely retain the inner base 36 of each respective vane 34. The tapered configuration of each recess 22 and the corresponding taper of each inner base 36 facilitates the alignment and proper seating. Similarly, each aperture 28 in the outer shroud ring 14 is tapered slightly to receive the outer base 38 which is provided with a similar taper. The respective tapers of the apertures 28 and outer bases 38 both facilitate proper seating and prevent any broken portions of the vane falling inwardly. Preferably the tapers described above are between 5° and 20° from the radial direction.

It should be emphasized that the ceramic nozzle assembly 10 is not fixedly mounted to any adjacent metallic component of the engine 46. Rather, the ceramic nozzle assembly 10 is retained in a secure but floating condition within the engine 46. More particularly, the spring finger 72 enables a radially inward movement of the ceramic nozzle assembly 10 or a radially outward expansion of the engine due to temperature changes. This movement is further enabled by gap "a" between the inner circumferential surfaces 16 of the inner shroud and the adjacent inner metal support 58, as shown in both FIGS. 2 and 3. Similarly, the ceramic nozzle assembly 10 can move in a radially upward direction by virtue of gaps "b", "c" and "d" which are located adjacent the outer circumference of the ceramic nozzle assembly 10. More particularly, the anti-rotation support 74 extending from the outer metal support 60 is spaced from the bottom of slots 32 in the outer shroud ring 14 by dimension "b". Similarly, the outwardly extending flange 42 of the outer support ring 40 is spaced from the outer metal support 60 by gap "c". Additionally, the outer support ring 40 is spaced from the shroud 56 by dimension "d". As a result of these gaps relative radial movement between the ceramic nozzle assembly 10 and adjacent metallic components of the engine can take place in response to various temperature and pressure variations within the engine.

Axial movement of the ceramic nozzle assembly 10 also is possible in response to temperature and pressure conditions in the engine. More particularly, the inner and outer metal supports 58 and 60 are constructed to yield slightly in response to pressures exerted axially upon the ceramic nozzle assembly 10. Additionally, both the spring 64 and the spring seal plate 70 are adapted to move in axial directions.

It should be emphasized that although limited amounts of both radial and axial floating of the ceramic nozzle assembly 10 within the engine 46 is possible, the ceramic nozzle assembly 10 will be urged into a substantially stationary position by the forces of the combustion gases exerted thereon.

In summary, a ceramic nozzle assembly is provided for use in a gas turbine engine. The ceramic nozzle assembly includes an inner shroud ring and an outer shroud ring dimensioned to be disposed concentrically relative to one another. The inner shroud ring is provided with recesses in the outer circumferential surface thereof. The outer shroud ring is provided with apertures which are radially in register with the recesses in the inner shroud ring. Vanes are adapted to be inserted through the apertures in the outer shroud ring to be securely seated in the recesses in the inner shroud ring. An outer support ring then is provided to slide over the outer shroud ring to securely retain the vanes in their proper position. Pockets or slots are provided in both the inner and outer shroud ring to mate with appropriate supports on the engine for preventing rotation on the nozzle assembly.

While the invention has been described with respect to a preferred embodiment, it is obvious that various changes and modifications can be made without departing from the spirit of the invention which should be limited only by the scope of the appended claims.

What is claimed is:

1. A ceramic nozzle assembly for a gas turbine engine comprising:

an annular inner shroud ring comprised of a ceramic material and having opposed inner and outer circumferential surfaces, the outer circumferential surface of the inner shroud ring being defined by a plurality of recesses extending generally radially inwardly;

an annular outer shroud ring comprised of a ceramic material and having an inner diameter greater than the diameter defined by the outer circumferential surface of said inner shroud ring, said outer shroud ring being concentrically disposed above the inner shroud ring, said outer shroud ring including a plurality of apertures extending therethrough, said apertures corresponding in number to said recesses in said inner shroud ring and being radially in register respectively with said recesses in the outer circumferential surface of the inner shroud ring;

a plurality of ceramic vanes extending radially between the inner and outer shroud rings, each said vane including opposed inner and outer ends with the inner end of each vane being engaged in the recess in the inner shroud ring and with the outer end of each vane being engaged in the corresponding aperture in the outer shroud ring; and an annular outer support ring comprised of a ceramic material and having an inner diameter greater than an outer diameter of said outer shroud ring, said outer support ring being dimensioned to slidably engage the respective outer ends of the vanes, said outer support ring including an inwardly extending flange adjacent one axial end thereof, said inwardly extending flange of said outer support ring abutting one axial end of said outer support ring to limit relative axial movement therebetween.

2. A ceramic nozzle assembly as in claim 1 wherein the inner shroud means includes anti-rotation means for engaging a nonrotating part of the gas turbine engine to prevent rotation of the ceramic nozzle assembly relative to the engine.

3. A ceramic nozzle assembly as in claim 2 wherein the anti-rotation means on the inner shroud ring includes an outwardly extending recess formed in the inner circumferential surface of the inner shroud ring.

4. A ceramic nozzle assembly as in claim 1 wherein the outer shroud ring includes anti-rotation means for engaging a nonrotating part of the gas turbine engine.

5. A gas turbine engine as in claim 4 wherein the outer shroud ring includes an outwardly extending annular flange adjacent one axial end thereof, said anti-rotation means defining at least one notch formed in the flange, said notch being dimensioned to engage a nonrotating part of the gas turbine engine.

6. A gas turbine engine as in claim 5 wherein the notch is generally axially aligned.

7. A ceramic nozzle assembly as in claim 1 wherein the outer shroud ring includes an outer circumferential surface, said vanes being dimensioned such that at least a portion of the outer end of each said vane is adjacent the outer circumferential surface of said outer shroud ring, said outer support ring being dimensioned to slidably engage both the outer circumferential surface of said outer shroud ring and the outer ends of the vanes.

8. A ceramic nozzle assembly as in claim 1 wherein said engine comprises anti-rotation supports nonrotatably mounted thereto, and wherein said inner and outer shroud rings each include at least one anti-rotation means for engaging the anti-rotation supports of said engine.

9. A ceramic nozzle assembly as in claim 8 wherein the anti-rotation supports are formed from metallic materials.

10. A ceramic nozzle assembly as in claim 1 wherein said assembly is dimensioned to enable limited movement in both the axial and radial directions relative to the engine, whereby said movement of the ceramic nozzle assembly enables said assembly to float in response to temperature and pressure related dimensional changes of the engine.

11. A ceramic nozzle assembly for a gas turbine engine comprising:

a generally annular inner shroud ring including at least one anti-rotation means for engaging a nonrotating part of the engine and a plurality of vane mounting means;

an outer shroud ring of greater diameter than the inner shroud ring and disposed concentrically thereabout, said outer shroud ring including at least one anti-rotation means for engaging a nonrotating part of the engine and a plurality of vane mounting means disposed generally radially in register respectively with vane mounting means of the inner shroud ring;

a plurality of radially aligned vanes extending between the respective vane mounting means of the inner shroud ring and the vane mounting means in register therewith on the outer shroud ring; and an outer support ring slidably mounted on said outer shroud ring, said outer support ring being in contact with at least a portion of each vane, whereby said outer support ring securely retains the vanes in the nozzle assembly, said outer shroud ring including an outwardly extending flange at one axial end thereof and wherein the outer support ring includes an outwardly extending flange at one axial end thereof, the outwardly extending flanges of said outer shroud ring and said outer support ring being adjacent one another.

12. A ceramic nozzle as in claim 11 wherein the vane mounting means of the inner shroud ring defines a plurality of recesses in the outer circumferential surface thereof.

13. A ceramic nozzle assembly as in claim 11 wherein the vane mounting means of the outer shroud ring comprises a plurality of apertures extending therethrough in a generally radial direction.

14. A ceramic nozzle assembly as in claim 11 wherein the anti-rotation means of the inner shroud ring comprises at least one radially outwardly extending recess formed in the inner circumferential surface thereof.

15. A ceramic nozzle assembly as in claim 11 wherein the anti-rotation means of the outer shroud ring comprises at least one slot formed in the outer circumferential surface thereof.

16. A nozzle assembly for a gas turbine engine comprising:

a ceramic inner shroud ring including at least one anti-rotation means formed therein and a plurality of vane mounting means;

a ceramic outer shroud ring concentrically surrounding the inner shroud ring, said outer shroud ring including at least one anti-rotation means therein and a plurality of vane mounting means disposed thereabout generally radially in register with the vane mounting means of the inner shroud ring;

a plurality of generally radially aligned ceramic vanes extending between and mounted to the registered vane mounting means of the respective inner and outer shroud rings;

a ceramic outer support ring concentrically surrounding at least a portion of the outer shroud ring and securely retaining the vanes in the respective mounting means of the inner and outer shroud rings;

an inner anti-rotation support for preventing rotation of the nozzle relative to the engine, said inner anti-rotation support being securely and nonrotatably mounted to the engine and in engagement with said anti-rotation means of the inner shroud ring;

outer anti-rotation support for preventing rotation of the nozzle relative to the engine, said outer anti-rotation support being securely and nonrotatably mounted to the engine and engaging the outer anti-rotation means of the outer support ring;

inner metal support securely mounted to the engine and disposed generally adjacent one axial end of the inner shroud ring;

inner spring means mounted to the engine and disposed adjacent the axial end of the inner shroud ring opposite the inner metal support, said inner spring means being operative to bias the inner shroud ring against the inner metal support;

outer metal support securely and nonrotatably mounted to the engine and being disposed in contact with a surface of the outer support ring;

outer spring means securely and nonrotatably mounted to the engine and in contact with a surface of the outer shroud ring, said outer spring means being operative to bias the nozzle against the outer metal support.

* * * * *